US008607979B1

(12) United States Patent
Cody

(10) Patent No.: US 8,607,979 B1
(45) Date of Patent: Dec. 17, 2013

(54) PAINT BRUSH PROTECTOR AND MAINTENANCE DEVICE

(76) Inventor: Scott G. Cody, Regina (CA)

( * ) Notice: Subject to any disclaimer, the term of this patent is extended or adjusted under 35 U.S.C. 154(b) by 288 days.

(21) Appl. No.: 13/029,596

(22) Filed: Feb. 17, 2011

Related U.S. Application Data

(60) Provisional application No. 61/305,400, filed on Feb. 17, 2010.

(51) Int. Cl.
*B65D 83/10* (2006.01)

(52) U.S. Cl.
USPC ..... 206/361; 206/362; 206/15.3; 15/142

(58) Field of Classification Search
USPC ..... 206/38, 581, 240, 361–362; 220/500, 220/503, 504, 505, 524; 132/297, 300; 15/236.05, 106, 249.3, 142, 236.06
See application file for complete search history.

(56) References Cited

U.S. PATENT DOCUMENTS

| | | | | | |
|---|---|---|---|---|---|
| 2,856,622 | A | | 10/1958 | Jacobsen | |
| 3,732,973 | A | * | 5/1973 | Crawford | 206/216 |
| 3,981,399 | A | | 9/1976 | Crouch | |
| 4,751,762 | A | | 6/1988 | Meimeteas | |
| 4,847,939 | A | | 7/1989 | Derencsenyi et al. | |
| 4,865,188 | A | | 9/1989 | Custeau | |
| 5,076,460 | A | * | 12/1991 | Hussell | 220/4.22 |
| 5,097,967 | A | | 3/1992 | Sica | |
| 5,244,090 | A | * | 9/1993 | Keith | 206/361 |
| 5,540,363 | A | | 7/1996 | Wilson | |
| 5,638,957 | A | * | 6/1997 | Brasier | 206/581 |
| 5,797,489 | A | | 8/1998 | Baker | |
| D434,566 | S | | 12/2000 | Mann | |
| 6,675,966 | B1 | | 1/2004 | Ray | |
| 8,157,091 | B2 | * | 4/2012 | Gabbard | 206/362.4 |
| 2004/0050732 | A1 | * | 3/2004 | Baker | 206/361 |
| 2005/0155618 | A1 | * | 7/2005 | Lafferty | 132/104 |
| 2007/0170079 | A1 | | 7/2007 | Gangemi | |

* cited by examiner

*Primary Examiner* — Mickey Yu
*Assistant Examiner* — Chun Cheung
(74) *Attorney, Agent, or Firm* — Montgomery Patent & Design; Robert C. Montgomery

(57) ABSTRACT

A paint brush protector and maintenance device provides storage, protection, and care for paint brushes includes a clamshell enclosure that opens to encase bristle and ferrule portions of a paint brush. The enclosure in at least one embodiment provides a rigid plastic to ensure that the bristles remain in a straight position and a plurality of drying holes along a front surface to aid in drying the bristles after cleaning. An end portion of the enclosure has a compressible stabilizer pad to hold the paint brush securely in place. The apparatus also provides a brush comb that clips onto the exterior of the enclosure providing a toothed comb and a pair of stiff bristle brushes to clean and condition the bristles as needed.

16 Claims, 5 Drawing Sheets

PAINT BRUSH PROTECTOR AND MAINTENANCE DEVICE

RELATED APPLICATIONS

The present invention was first described in and claims the benefit of U.S. Provisional Application No. 61/305,400 filed Feb. 17, 2010, the entire disclosures of which are incorporated herein by reference.

FIELD OF THE INVENTION

The present invention relates generally to paint brush protectors, and in particular, to a paint brush cover including a brush maintenance accessory.

BACKGROUND OF THE INVENTION

Painting projects are known to often take a long time for completion due to their repetitive, precise, and extensive nature. Depending on the particular project, there are a variety of tasks to perform including removing old paint, cleaning the surface, prepping the surface, mixing the paint, applying the paint, and cleaning up. In all such projects, the use of a paint applicator such as a paintbrush is integral to most steps of the process. The brush is utilized to mix or apply the paint. After use, the paintbrush is typically cleaned and stored until next time, as the project may occur over several days or sessions.

During such intermediate periods, paint brushes may be stored in a cabinet, in a drawer, on a hook or in a similar location. To help protect the bristles, many painters place the brush back in its packaging containers. This is intended to help maintain the bristle shape and keep it clean and free from dirt. However, such packaging is often made of cardboard which does not hold up over time. Those that do not use any covering risk the brush becoming dirty, dusty, or deformed if it dries at an angle against another object.

Various attempts have been made to provide paint brush maintenance devices. Examples of these attempts can be seen by reference to several U.S. patents. U.S. Pat. No. 3,981,399, issued in the name of Crouch, describes an apparatus for holding a paint brush including a "V"-shaped interior wall to receive the bristled end of the brush.

U.S. Pat. No. 4,751,762, issued in the name of Meimeteas, describes a paint brush cover with a hook formed integrally with an exterior portion of the device, enabling the paint brush to be hung onto an edge of a paint container or similar object.

U.S. Pat. No. 4,847,939, issued in the name of Derencsenyi et al., describes a protective paint brush sleeve for protecting paintbrushes during soaking and storage.

U.S. Pat. No. 4,865,188, issued in the name of Custeau, describes a cleaning assembly for a paint brush including a container with a volume of paint solvent and a top mouth for receiving and retaining a paint brush within the solvent for cleaning.

U.S. Pat. No. 5,097,967, issued in the name of Sica, describes a paint brush cleaning, drying, and storage container including a brush hanger bar with a plurality of adjustable hooks for the raising and lowering of paint brushes independent of each other in a suspended position.

U.S. Pat. No. 6,675,966, issued in the name of Ray, describes a shuck for drying a paintbrush including an air-permeable screen mesh portion.

While these devices fulfill their respective, particular objectives, each of these references suffer from one (1) or more of the aforementioned disadvantages. Many such devices occupy a significantly increased amount of space compared to the brush itself. Also, many such devices do not provide adequate shaping, protection, and drying to the bristles portions of the brush. Furthermore, many such devices do not provide inherent capabilities for conditioning a brush and must be utilized in conjunction with peripheral objects or substances. Accordingly, there exists a need for a paint brush protector and maintenance device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a simple paint brush protector facilitating various aspects of used-brush maintenance including conditioning, protection, shaping, and drying. Thus, the object of the present invention is to solve the aforementioned disadvantages and provide for this need.

To achieve the above objectives, it is an object of the present invention to protect a paint brush during periods of non-use. The device is a clamshell-style enclosure including a front housing and a hingedly connected rear housing which enclose a bristle portion and a ferrule portion of the paint brush when closed. The device can be secured in the closed position with a latch.

Another object of the present invention is to maintain the condition and shape of the bristle portion of the brush. The enclosure comprises a shape corresponding to a desired shape of the bristle portion when closed such that the bristles are caused to dry in said desired shape.

Yet still another object of the present invention is to securely retain the brush within the enclosure using a brush stabilizer. The brush stabilizer is disposed on an interior surface of the front housing and applies a clamping force against the ferrule portion of the paint brush when closed, retaining the brush in place via friction.

Yet still another object of the present invention is to provide ventilation to the brush when the enclosure is closed in order to promote drying and inhibit mold from forming within the bristle portion. The enclosure includes a plurality of air flow apertures which enable environmental air to enter and exit the enclosure and dry the bristles.

Yet still another object of the present invention is to provide a brush comb for conditioning and maintaining the paint brush bristle portion prior to enclosing the paint brush within the device. The brush comb is housed within a brush comb enclosure disposed along an exterior surface of the rear housing of the device.

Yet still another object of the present invention is to utilize the brush comb in conjunction with manufacturer-specified cleaning instructions for a paint brush in order to condition the bristles of the brush prior to storage. The brush comb includes a comb comprised of a plurality of rigid teeth, a first brush, and a second brush. The comb is utilized to straighten the bristle portion after cleaning and prior to placement in the device while each brush comprise a plurality of bristles of varying materials utilized to condition different types of paint brush bristles.

Yet still another object of the present invention is to provide a method of utilizing the device that provides a unique means of procuring a model of the device having a shape and size corresponding to a particular paint brush. After using the paint brush, the user cleans the paint brush according to the prescribed cleaning method and by repeatedly stroking the bristle portion of the paint brush with the comb, the first brush, or the second brush as desired. The user opens the device and places the paint brush within the rear housing such that the bristle portion is oriented with the shape of the rear housing. The front housing is rotated into the closed position and secured by reengaging the latch. The bristle portion contacts a distal end of the front housing and rear housing and is forced into a desirable tapered shape. The paint brush is maintained in this desirable shape with the stabilizer and receives a drying air flow via the plurality of air flow apertures.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
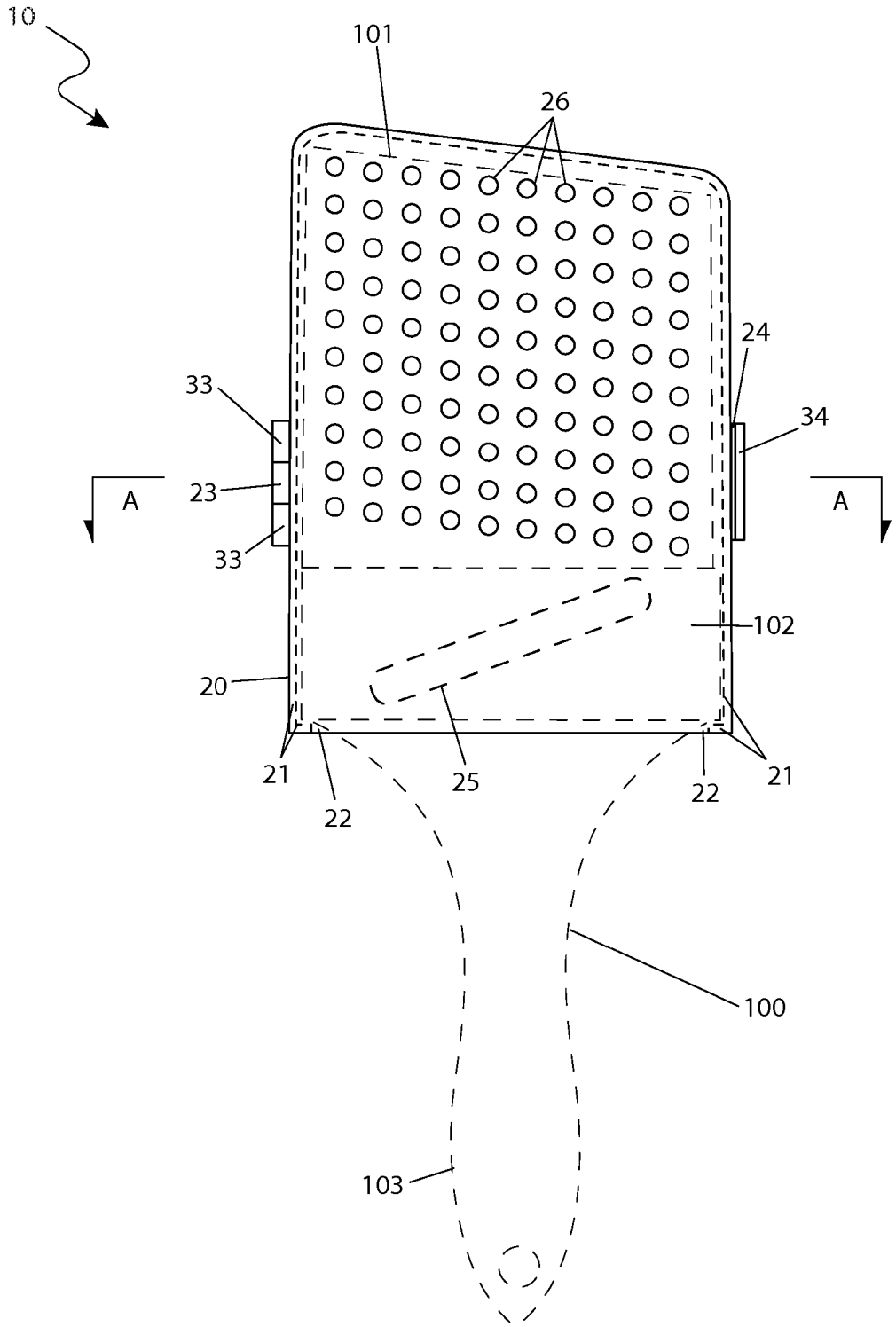
FIG. 1 is an orthographic top view of a paint brush protector and maintenance device, according to a preferred embodiment in accordance with the invention.

10 paint brush protector and maintenance device
20 front housing
21 front housing rim
22 front housing opening
23 first hinge
24 receiving latch
25 brush stabilizer
26 air flow aperture
30 rear housing
31 rear housing rim
32 rear housing opening
33 second hinge
34 latch
40 brush comb enclosure
41 brush comb enclosure hinge
42 brush comb enclosure latch
50 brush comb
51 comb
52*a* first brush
52*b* second brush
53 brush comb body
100 paint brush
101 bristle portion
102 ferrule
103 handle

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes paint brush protector and maintenance device (herein described as a "device") 10 for protecting a paint brush 100 during periods of non-use and for maintaining the condition and shape of a bristle portion 101 of the paint brush 100.

FIG. 1 shows an orthographic top view of the device 10. The device 10 is a clamshell style enclosure which encloses the bristle portion 101 and a ferrule 102 of the paint brush 100 when in a closed position. The device 10 includes a front housing 20 and a similarly shaped rear housing 30 (see FIG. 2) which provide a hollow protective structure in a shape corresponding to the bristle portion 101. The front housing 20 is shown here as having a tapered shape corresponding to a tapered shape of the bristle portion 101, however it can be appreciated by one skilled in the art that other shapes corresponding to a variety of paint brushes will work equally well, and as such should not be interpreted as a limiting factor of the present device 10. The front housing 20 and rear housing 30 are preferably constructed of a lightweight plastic material providing a rigid and non-reactive protective enclosure to the paint brush 100 between uses.

An interior perimeter edge of the front housing 20 includes an integrally molded front housing rim 21 which extends inwardly from the interior surface of the front housing 20. The front housing rim 21 terminates at a proximal end of the front housing 20. The front housing rim 21 correspondingly engages a rear housing rim 31 when the device 10 is in a closed position to provide a continuous outer profile along the device. The rear housing rim 31 is integrally molded to the rear housing 30 in a similar manner as the front housing rim 21. The proximal end of the front housing 20 and the rear housing 30 further includes a front housing opening 22 and a rear housing opening 32 which provide a recess for a handle 103 of the paint brush 100 to extend out from the device 10 when the device 10 is in the closed position.

The front housing 20 is hingedly connected to the rear housing 30 by a first hinge 23. The first hinge 23 is affixed to a side of the front housing 20 and surrounds a middle portion of a second hinge 33 (see FIG. 5) which is affixed to the rear housing 30. The hinges 23, 33 form a rotatable "tee" hinge. It can be appreciated by one skilled in the art that other hinge mechanisms such as butterfly hinges, butt hinges, and the like will work equally well, and as such should not be interpreted as a limiting factor of the present device 10. The device 10 can be secured in the closed position with a latch 34 affixed to the rear housing 30. The latch 34 engages a receiving latch 24 which is located on the front housing 20. The latch 34 and the receiving latch 24 are located opposite the second hinge 33 and the first hinge 23, respectively.

The device 10 further includes a brush stabilizer 25 affixed to an interior surface of the front housing 20 adjacent to the front housing opening 22. The brush stabilizer 25 comprises a structure which protrudes inwardly from the interior surface of the front housing 20 to contact the ferrule 102 when the paint brush 100 is placed within the device 10. When the device 10 is in the closed position, the brush stabilizer 25 applies a clamping force to the ferrule 102 and the rear housing 30 to stabilize and retain the paint brush 100. The brush stabilizer 25 preferably comprises a unitary, perpendicularly extending ridge which is integrally molded with the front housing 20 during manufacturing. However, it can be appreciated by one skilled in the art that the brush stabilizer 25 can comprise a variety of shapes and materials, and can be affixed to the front housing 20 using a variety of methods such as molding, plastic welding, or an adhesive and as such should not be interpreted as a limiting factor of the present device 10.

The top surface of the front housing 20 includes a plurality of air flow apertures 26. The plurality of air flow apertures 26 preferably comprises a plurality of circular openings approximately one-eighth (⅛) to one-quarter (¼) of an inch in diameter. The plurality of air flow apertures 26 provides ventilation of the paint brush bristle portion 101 while the device 10 is in the closed position. It can be appreciated by one skilled in the art that the plurality of air flow apertures 26 can comprise a variety of spacings, shapes, and sizes and as such should not be interpreted as a limiting factor of the present device 10.

Figure 2:
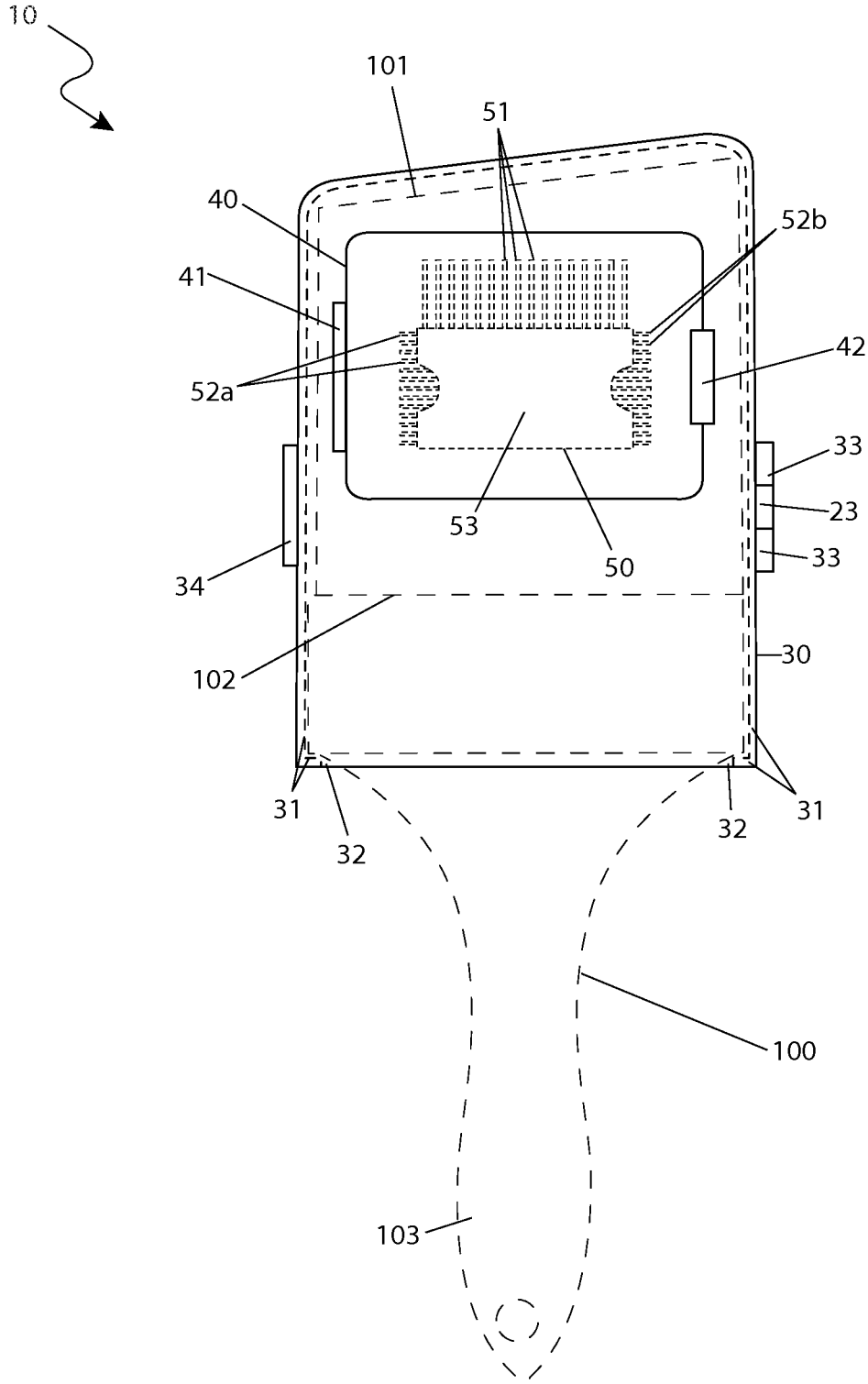
FIG. 2 is an orthographic bottom view of the paint brush protector and maintenance device, according to the preferred embodiment.

FIG. 2 shows an orthographic bottom view of the device 10. The rear housing 30 is constructed of the same material as the front housing 20. The rear housing rim 31 is similarly constructed and shaped to the front housing rim 21.

Figure 5:
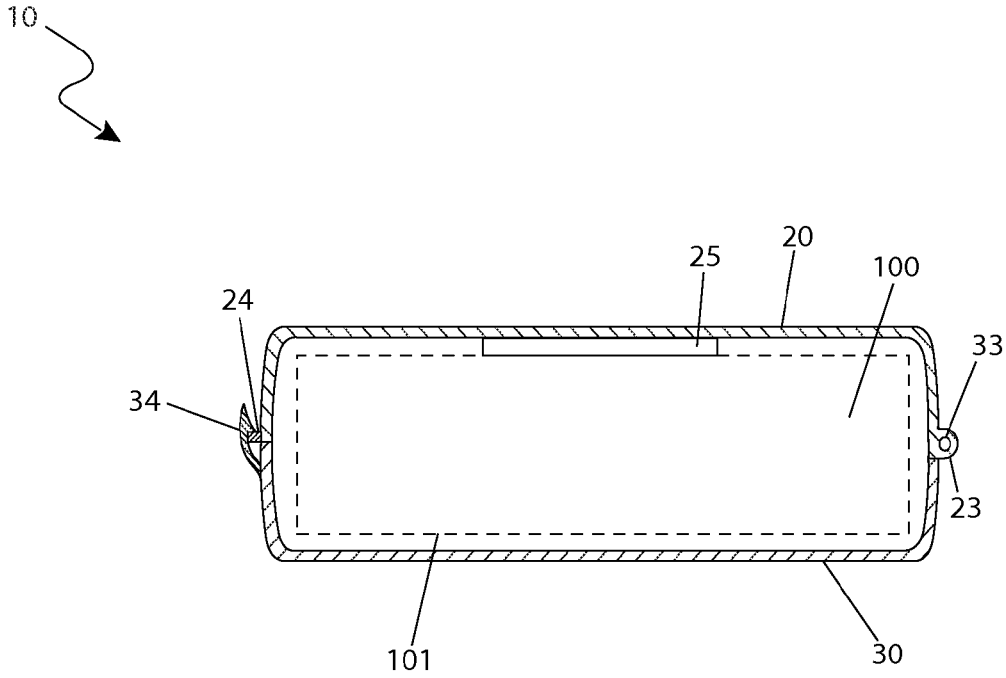
FIG. 5 is a cross-sectional view of the paint brush protector and maintenance device taken along the line A-A (see FIG. 1), according to the preferred embodiment; and, FIG. 6 is a perspective view of a brush comb, according to the preferred embodiment.
Figure 6:
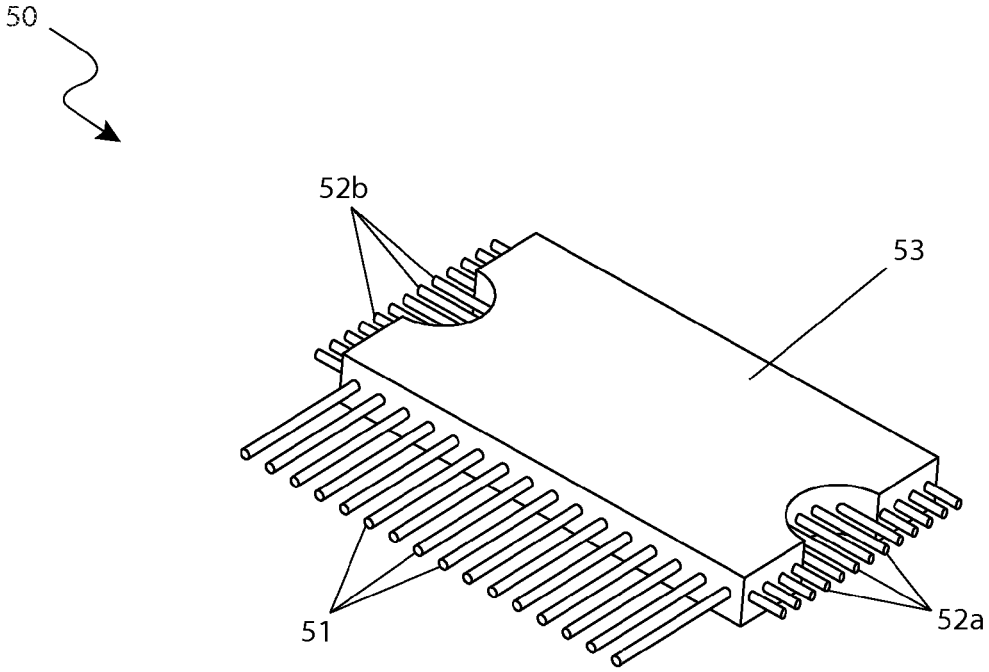

The device 10 further includes a brush comb enclosure 40 which houses and protects a brush comb 50 (see FIG. 6). The brush comb 50 is a combing tool for conditioning and maintaining the paint brush bristle portion 101 prior to enclosing the paint brush 100 within the device 10. The brush comb enclosure 40 is preferably constructed of a similar material to the rear housing 30. The brush comb enclosure 40 is attached to the rear housing 30 with a brush comb enclosure hinge 41 such that the brush comb enclosure 40 can hinge outwardly from the rear housing 30. The brush comb enclosure 40 can be further secured in a closed position with a brush comb enclosure latch 42 affixed to the rear housing 30 and similar in construction to the latch 34 (see FIG. 5.). In at least one (1) alternate embodiment, the rear housing 30 and brush comb enclosure 40 further comprise a plurality of air flow apertures similar to the air flow apertures 26 of the front housing 20.

Figure 3:
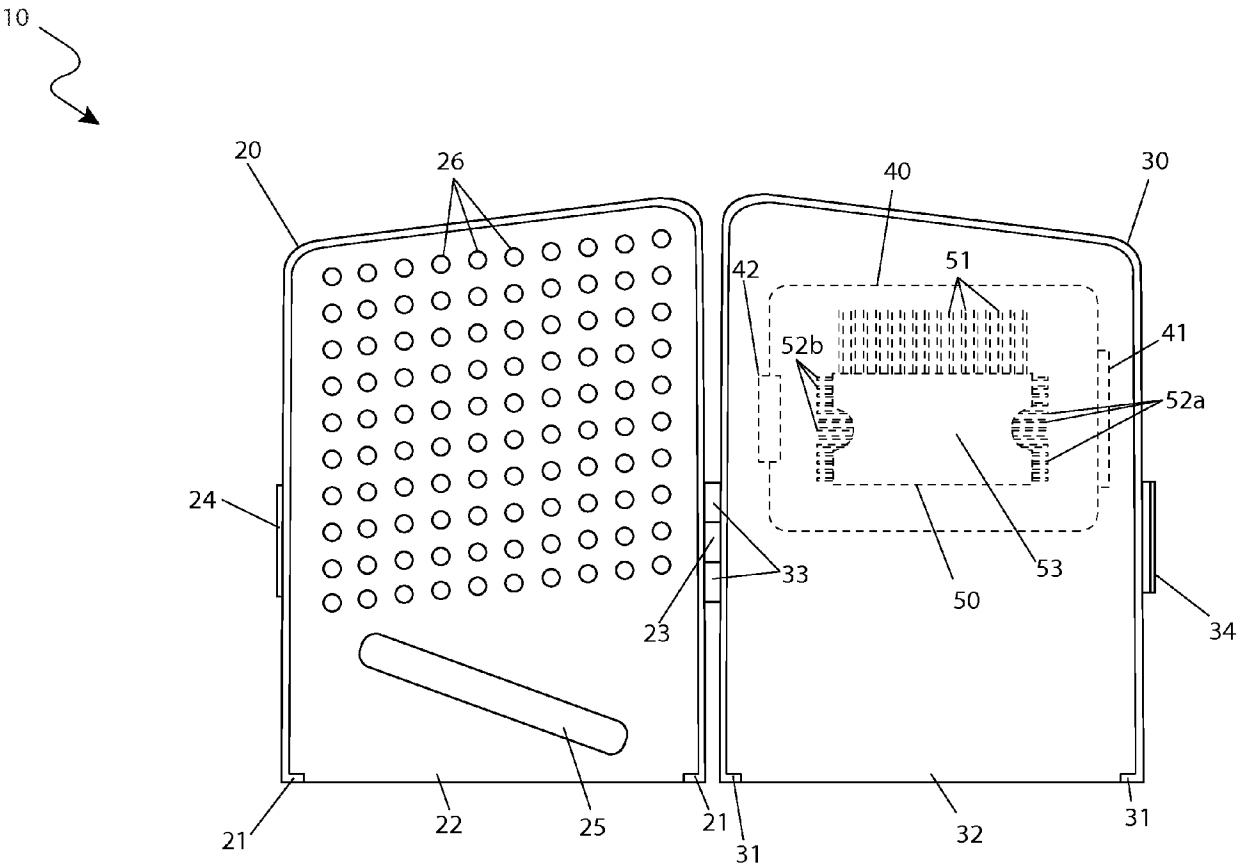
FIG. 3 is an orthographic view of the paint brush protector and maintenance device in an open position, according to the preferred embodiment.

FIG. 3 shows an orthographic view of the device 10 in an open position. A user can motion the latch 34 and rotate the front housing 20 relative to the rear housing 30 about the hinges 23, 33 in order to expose the interior of the device 10, thereby allowing the user to place a paint brush 100 within the device 10.

Figure 4:
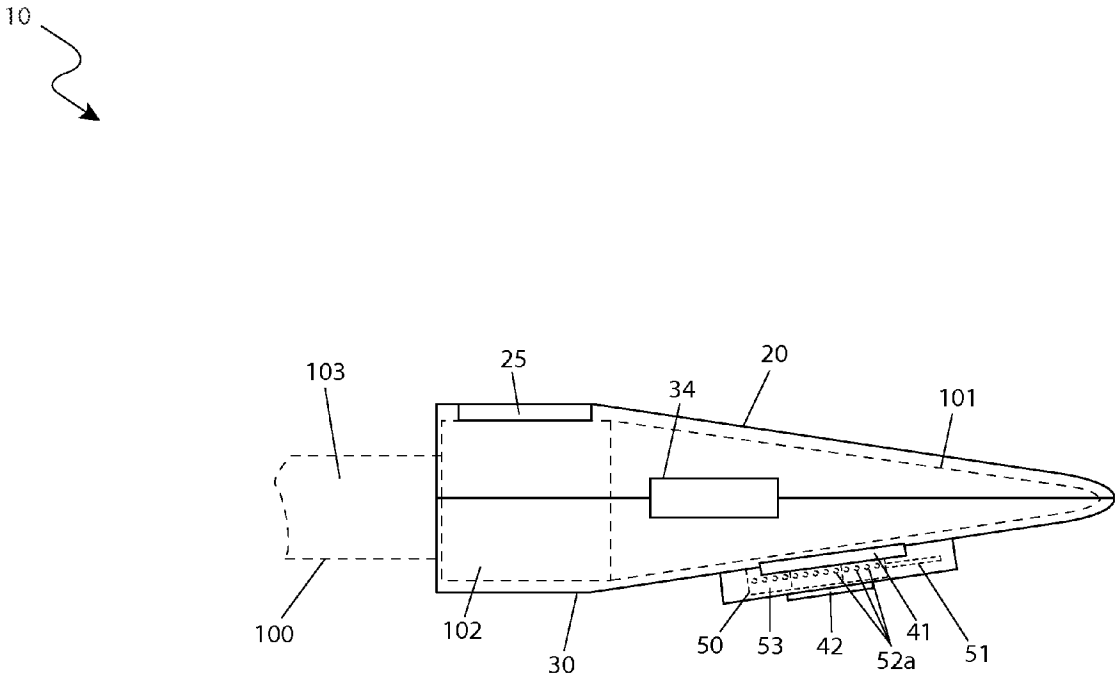
FIG. 4 is an orthographic side view of the paint brush protector and maintenance device, according to the preferred embodiment.

FIG. 4 shows an orthographic side view of the device 10. Once the paint brush 100 is placed within the device 10, the user returns the device 10 to the closed position by motioning the front housing 20 about the hinges 23, 33 to contact the latch 34 and correspondingly engage the front housing rim 21 with the rear housing rim 31. Once the bristle portion 101 is enclosed within the device 10, the user can push on the handle 103, applying enough force to overcome the friction provided by the stabilizer 25 and forcing the distal end of the bristle portion 101 towards the distal tapered end of the front housing 20 and rear housing 30. As the user forces the bristle portion 101 into the tapered profile of the device 10, the bristle portion 101 is forced to compress against the front housing 20 and rear housing 30. Once the user stops pushing on the brush, the stabilizer 25 will retain the ferrule 102 and bristle portion 101 in this position and ensure that the bristle portion 101 remains compressed until removed for subsequent use. In this manner, the device 10 helps to mitigate "tip curl", or drying and subsequent biasing of the bristle portion 101 in an unfavorable position. The plurality of air holes 26 contribute to this favorable drying of the bristle portion 101 of by providing sufficient contact with environmental air.

FIG. 5 shows a cross-sectional view of the device 10 taken along line A-A of FIG. 1. The receiving latch 24 of the front housing 20 comprises a flat, indented surface which retains a corresponding surface of the latch 34. To open the device 10, the user pulls the latch 34 outwardly to disengage the receiving latch 24. The front housing 20 can then be freely rotated about the second hinge 33. The device 10 can be closed by simply rotating the front housing 20 against the latch 34 such that the receiving latch 24 contacts a slanted portion of the latch 34 and forces the latch 34 outward, thereby reengaging the latch 34 to the receiving latch 24 and securing the device 10 in the closed position.

FIG. 6 shows a perspective view of the brush comb 50. The brush comb 50 comprises a comb 51, a first brush 52*a*, and a second brush 52*b* affixed to a brush comb body 53. The brush comb body 53 is generally rectangular with the comb 51, the first brush 52*a*, and the second brush each affixed to a different side surface and at least one (1) side surface vacant to facilitate gripping of the brush comb body 53. The brush comb 50 is utilized in conjunction with manufacturer-specified cleaning instructions for the paint brush 100. The comb 51 comprises a plurality of rigid, equally-spaced teeth extending perpendicularly from a side surface of the comb body 53. The comb 51 is utilized to straighten the bristle portion 101 after cleaning and prior to placement in the device 10. The first brush 52*a* and the second brush 52*b* each comprise a plurality of bristles affixed to the brush comb body 53 and forming a brush-like assembly that can be used to condition various types of paint brushes as desired. In a preferred embodiment, the first brush 52*a* includes bristles made from copper and the second brush 52*b* includes bristles made from a non-metallic material such as a plastic polymer.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the common user in a simple and effortless manner with little or no training. First, the user procures a model of the device 10 having a shape and size corresponding to a particular paint brush 100. After using the paint brush 100, the user cleans the paint brush 100 according to the prescribed cleaning method. After cleaning, the user removes the comb brush 50 from the comb brush enclosure 40 by disengaging the comb brush enclosure latch 42 and opening the comb brush enclosure 40 with the comb brush enclosure hinge 41. The comb brush 50 is utilized by gripping the comb brush body 53 and repeatedly stroking the bristle portion 101 of the paint brush 100 with the comb 51, the first brush 52*a*, or the second brush 52*b* as desired. Then comb brush 50 is then replaced within the comb brush enclosure 40 and the comb brush enclosure 40 is secured in a closed position with the comb brush enclosure latch 42.

The user then opens the device 10 by motioning the latch 34 outward and rotating the front housing 20 about the second hinge 33. The user places the bristle portion 101 and the ferrule 102 of the paint brush 100 on the interior surface of the rear housing 30 such that the bristle portion 101 is oriented with the shape of the rear housing 30. The front housing 20 is then rotated back into the closed position and secured by reengaging the receiving latch 24 with the latch 34. The user can then grip the handle 103 of the paint brush 100 to force the bristle portion 101 to contact the distal end of the front housing 20 and rear housing 30, thereby forcing the bristle portion 101 into a desirable tapered shape. The paint brush 100 is maintained in this position due to the frictional force provided by the stabilizer 25 against the ferrule 102. The bristle portion 101 is dried and maintained in this desirable shape during the period of non-use and receives a favorable air flow via the plurality of air flow apertures 26. When the paint brush 100 is needed again, the user simply disengages the latch 34 to remove the paint brush 100 and proceeds to utilize the favorably maintained bristle portion 101 as before.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A paint brush protector, comprising:

a clamshell-style hinged enclosure, comprising:

a five-sided hollow housing having an enclosure opening at a lower end thereof;

a brush comb enclosure hingedly attached thereto, comprising:

a generally rectangular brush comb body, having a first side edge with a concave portion and a second side edge having a concave portion opposite said first side edge, a top side edge and a bottom side edge;

a comb, comprising a plurality of equally-spaced rigid teeth extending outwardly from said top side edge of said brush comb body;

a first brush, comprising a plurality of bristles affixed to said first side edge and extending an entire width of said concave portion; and, a second brush, comprising a plurality of bristles affixed to said second side edge and extending an entire width of said concave portion;

a front housing having an inner side and an outer side, further comprising a first side and a second side and a front housing opening at a lower inner edge thereof;

a rear housing having an inner side and an outer side, further comprising a first side hingedly connected to said front housing first side, a second side removably fastened to said front housing second side, and a rear housing opening at a lower inner edge thereof;

a front housing rim integrally molded to a perimeter edge of said front housing inner side and terminating at said front housing opening;

a rear housing rim integrally molded to a perimeter edge of said rear housing inner side and terminating at said rear housing opening;

a hinging means, comprising:

a first hinge affixed to and extending outwardly from said front housing first side; and, a second hinge affixed to and extending outwardly from said rear housing first side rotatably affixed to said first hinge; and, a latching means, comprising:

a latch affixed to said rear housing second side; and, a receiving latch affixed to said front housing second side for removably receiving said latch;

a plurality of ventilation apertures located on one side of said hinged enclosure; and, said brush comb body removably retained in said brush comb enclosure;

wherein said enclosure is openable between an open configuration and a closed configuration;

wherein said front housing rim engages said rear housing rim to provide a continuous outer profile of said enclosure;

wherein said front housing opening and said rear housing opening form said enclosure opening when in said closed configuration;

wherein said brush comb enclosure is openable between an open configuration and a closed configuration to provide access to said brush comb;

wherein said first side edge concave portion and said second side edge concave portion each provide an enhanced gripping means for said brush comb; and, wherein said first side edge concave portion and said second side edge concave portion each provide an enhanced brushing means for curved or sharp edges of an item during storage or transport;

wherein said enclosure and said brush comb enclosure comprises a generally rigid and non-reactive material;

wherein said enclosure encloses a bristle portion and a ferrule portion of a paint brush therein, such that a handle portion extends outwardly through said enclosure opening; and, wherein said plurality of ventilation apertures provides ventilation to said bristle portion.

2. The protector of claim 1, wherein said enclosure comprises a tapering shape corresponding to a tapered shape of said paint brush bristle portion.

3. The protector of claim 1, wherein said plurality of ventilation apertures each further comprises a circular openings approximately one-eighth (%) to one-quarter (¼) of an inch in diameter;

wherein said plurality of ventilation holes are located on said front housing.

4. The protector of claim 1, further comprising a brush stabilizer located adjacent to said front housing opening and protruding inwardly from said front housing inner side;

wherein said brush stabilizer contacts said ferrule portion of said paint brush when inserted into said protector and in said closed position; and, wherein said brush stabilizer stabilizes said paint brush during storage and transport.

5. The protector of claim 4, wherein said brush stabilizer further comprises a unitary molded portion of said first housing.

6. The protector of claim 1, wherein said brush comb enclosure is affixed to a location on an outer surface of said rear housing, further comprising:

a five sided enclosure, comprising an outer side, a first side, a second side, a top side, and a bottom side;

a brush comb enclosure hinge located on said brush comb enclosure first side and hingedly attached to said rear housing; and, a brush comb enclosure latch located on said brush comb enclosure second side for removable latching onto a corresponding latch on said rear housing;

wherein said outer surface of said rear housing and said brush comb enclosure define an interior where said brush comb resides.

7. The protector of claim 1, wherein said first brush further comprises a plurality of copper bristles and said second brush further comprises a plurality of non-metallic bristles.

8. A paint brush protector, comprising:

a clamshell-style hinged enclosure, comprising:

a five-sided hollow housing having an enclosure opening at a lower end thereof;

a brush comb enclosure hingedly attached thereto, comprising:

a generally rectangular brush comb body, having a first side edge with a concave portion and a second side edge having a concave portion opposite said first side edge, a top side edge and a bottom side edge;

a comb, comprising a plurality of equally-spaced rigid teeth extending outwardly from said top side edge of said brush comb body;

a first brush, comprising a plurality of bristles affixed to said first side edge and extending an entire width of said concave portion; and, a second brush, comprising a plurality of bristles affixed to said second side edge and extending an entire width of said concave portion;

a front housing having an inner side and an outer side, further comprising a first side and a second side and a front housing opening at a lower inner edge thereof;

a rear housing having an inner side and an outer side, further comprising a first side hingedly connected to said front housing first side, a second side removably fastened to said front housing second side, and a rear housing opening at a lower inner edge thereof;

a front housing rim integrally molded to a perimeter edge of said front housing inner side and terminating at said front housing opening;

a rear housing rim integrally molded to perimeter edge of said rear housing inner side and terminating at said rear housing opening;

a hinging means, comprising:

a first hinge affixed to and extending outwardly from said front housing first side; and, a second hinge affixed to and extending outwardly from said rear housing first side rotatably affixed to said first hinge; and, a latching means, comprising:

a latch affixed to said rear housing second side; and, a receiving latch affixed to said front housing second side for removably receiving said latch;

a plurality of ventilation apertures located on said hinged enclosure and said brush comb enclosure; and, said brush comb body removably retained in said brush comb enclosure;

wherein said enclosure is openable between an open configuration and a closed configuration;

wherein said front housing rim engages said rear housing rim to provide a continuous outer profile of said enclosure;

wherein said front housing opening and said rear housing opening form said enclosure opening when in said closed configuration;

wherein said brush comb enclosure is openable between an open configuration and a closed configuration to provide access to said brush comb;

wherein said first side edge concave portion and said second side edge concave portion each provide an enhanced gripping means for said brush comb;

wherein said first side edge concave portion and said second side edge concave portion each provide an enhanced brushing means for curved or sharp edges of an item during storage or transport;

wherein said enclosure and said brush comb enclosure comprises a generally rigid and non-reactive material;

wherein said enclosure encloses a bristle portion and a ferrule portion of a paint brush therein, such that a handle portion extends outwardly through said enclosure opening; and, wherein said plurality of ventilation apertures provides ventilation to said bristle portion.

9. The protector of claim 8, wherein said enclosure comprises a tapering shape corresponding to a tapered shape of said paint brush bristle portion.

10. The protector of claim 8, wherein said plurality of ventilation apertures each further comprises a circular openings approximately one-eighth (%) to one-quarter (¼) of an inch in diameter;

wherein said plurality of ventilation holes are located on said front housing, said rear housing, and said brush comb enclosure.

11. The protector of claim 8, further comprising a brush stabilizer located adjacent to said front housing opening and protruding inwardly from said front housing inner side;

wherein said brush stabilizer contacts said ferrule portion of said paint brush when inserted into said protector and in said closed position; and, wherein said brush stabilizer stabilizes said paint brush during storage and transport.

12. The protector of claim 11, wherein said brush stabilizer further comprises a unitary molded portion of said first housing.

13. The protector of claim 8, wherein said brush comb enclosure is affixed to a location on an outer surface of said rear housing, further comprising:

a five sided enclosure, comprising an outer side, a first side, a second side, a top side, and a bottom side;

a brush comb enclosure hinge located on said brush comb enclosure first side and hingedly attached to said rear housing; and, a brush comb enclosure latch located on said brush comb enclosure second side for removable latching onto a corresponding latch on said rear housing;

wherein said outer surface of said rear housing and said brush comb enclosure define an interior where said brush comb resides.

14. The protector of claim 8, wherein said first brush further comprises a plurality of copper bristles and said second brush further comprises a plurality of non-metallic bristles.

15. A method for storing a paint brush within a paint brush enclosure, further comprising:

providing a paint brush enclosure, further comprising:

a hinged enclosure, comprising a five-sided hollow tapered housing having an enclosure opening at a lower end thereof, further comprising:

a front housing having an inner side and an outer side, further comprising a first side and a second side and a front housing opening at a lower inner edge thereof;

a rear housing having an inner side and an outer side, further comprising a first side hingedly connected to said front housing first side, a second side removably fastened to said front housing second side, and a rear housing opening at a lower inner edge thereof;

a front housing rim integrally molded to a perimeter edge of said front housing inner side and terminating at said front housing opening;

a rear housing rim integrally molded to perimeter edge of said rear housing inner side and terminating at said rear housing opening;

a hinging means, comprising a first hinge affixed to and extending outwardly from said front housing first side, and a second hinge affixed to and extending outwardly from said rear housing first side rotatably affixed to said first hinge; and, a latching means, comprising a latch affixed to said rear housing second side and a receiving latch affixed to said front housing second side for removably receiving said latch;

a brush comb enclosure affixed to a location on an outer surface of said rear housing, further comprising an outer side, a first side, a second side, a top side, and a bottom side, a brush comb enclosure hinge located on said brush comb enclosure first side and hingedly attached to said rear housing, and a brush comb enclosure located on said brush comb enclosure second side for removable latching onto a corresponding latch on said rear housing;

a brush stabilizer located adjacent to said front housing opening and protruding inwardly from said front housing inner side; and, a plurality of ventilation holes are located on said front housing, said rear housing, and said brush comb enclosure; and, a brush comb removably retained therein said brush comb enclosure, further comprising:

a generally rectangular brush comb body, having a first side edge with a concave portion and a second side edge having a concave portion opposite said first side edge, a top side edge and a bottom side edge;

a comb, comprising a plurality of equally-spaced rigid teeth extending outwardly from said top side edge of said brush comb body;

a first brush, comprising a plurality of bristles affixed to said first side edge and extending an entire width of said concave portion; and, a second brush, comprising a plurality of bristles affixed to said second side edge and extending an entire width of said concave portion;

placing said paint brush within said enclosure such that a bristle portion of said paint brush is above said brush stabilizer and said brush stabilizer contacts a ferrule portion of said paint brush;

closing said enclosure;

securing said enclosure by attaching said latch of said rear housing to said receiving latch of said front housing;

placing said brush comb within said brush comb housing;

closing said brush comb housing; and, securing said brush comb enclosure by latching said brush comb enclosure latch onto said corresponding latch on said rear housing.

16. The method of claim 15, further comprising the step of:

placing a wet paint brush within said paint brush enclosure; and, allowing said wet paint brush to dry without incurring tip curl of said bristle portion due to uneven drying of said bristle portion, wherein said paint brush enclosure maintains a shape of said bristle portion and said plurality of ventilation apertures provide even drying of said bristle portion.

* * * * *